US005713772A

United States Patent [19]

Takahashi et al.

[11] Patent Number: 5,713,772

[45] Date of Patent: Feb. 3, 1998

[54] COOLING ARRANGEMENT FOR OUTBOARD MOTOR

[75] Inventors: Masanori Takahashi; Hitoshi Watanabe, both of Hamamatsu, Japan

[73] Assignee: Sanshin Kogyo Kabushiki Kaisha, Hamamatsu, Japan

[21] Appl. No.: 693,390

[22] Filed: Aug. 7, 1996

[30] Foreign Application Priority Data

Aug. 7, 1995 [JP] Japan ..... 7-200683

[51] Int. Cl.[6] ..... B63H 21/24

[52] U.S. Cl. ..... 440/78; 123/195 P

[58] Field of Search ..... 123/41.65, 41.66, 123/195 P, 198 E; 440/88, 89, 76, 77, 900, 78

[56] References Cited

U.S. PATENT DOCUMENTS 4,721,485 1/1988 Suzuki ..... 123/195 P
5,445,547 8/1995 Furukawa ..... 440/77

FOREIGN PATENT DOCUMENTS 406016187 1/1994 Japan ..... 440/77

*Primary Examiner*—Ed. L. Swinehart
*Attorney, Agent, or Firm*—Knobbe, Martens, Olson & Bear LLP

[57] ABSTRACT

A number of embodiments of four-cycle internal combustion engines having belt-driven overhead cam shafts. The power head of the outboard motor includes a protective cowling that has an atmospheric air inlet and the air drawn through this atmospheric air inlet is directed over a timing belt that drives the cam shaft from the engine crankshaft for its cooling. The air flow is controlled either by utilization of fans, baffles and/or utilizing the flow of air caused by the induction system.

13 Claims, 8 Drawing Sheets

COOLING ARRANGEMENT FOR OUTBOARD MOTOR

BACKGROUND OF THE INVENTION

This invention relates to a cooling arrangement for an outboard motor and more particularly to an improved cooling arrangement for the cam shaft drive mechanism of a four-cycle outboard motor.

For several reasons, four-cycle engines are receiving renewed interest as potential power plants for outboard motors. The four-cycle engine has several advantages which makes it more desirable than the more compact, higher specific output two-cycle engines normally utilized for these applications. The prime advantage of four-cycle engines is that they have a wider usable power and speed band than two-cycle engines and also they offer the opportunity of better exhaust emission control, particularly when considering the lubrication of the engine.

However, in order to compete with the greater specific performance of a two-cycle engine, it has been generally the practice to employ high-performance variations of four-cycle engines for outboard motor applications. This results in the use of such features as single or multiple overhead cam shafts and other high-performance features.

As is well known and regardless of the engine type, an outboard motor presents a very demanding challenge for the designer. Not only is the space that is available for the engine restricted, the engine is also relatively closely confined within a surrounding protective cowling. Therefore, the cooling of certain engine components and auxiliaries presents particular problems.

This is also true with respect to the cam shaft drive mechanism for a four-cycle engine. A preferred form of cam shaft drive uses a toothed belt or the like for driving the cam shaft. Belt drives have certain advantages over chain drives, the prime one being silence in operation. However, belt driven cam shafts are generally exposed and are not cooled by the lubricating system for the engine as with the case with chain drives.

It is, therefore, a principal object of this invention to provide an improved four-cycle outboard motor embodying an improved cooling system for its cam shaft drive.

It is a further object of this invention to provide an improved four-cycle overhead cam engine embodying an arrangement for simplifying and highly effectively cooling the flexible transmitter drive for the overhead cam shaft or cam shafts.

As is well known, the air for combustion in an outboard motor is normally drawn through an atmospheric air inlet opening in the protective cowling. The design of these air inlet openings is such that they are configured so as to attempt to minimize the amount of water that is drawn into the interior of the protective cowling along with the inducted air. This is particularly important in conjunction with marine environments wherein the surrounding water may contain highly corrosive material such as salt which can be detrimental to the engine. Thus, the induction systems generally somewhat restrict the air flow into the protective cowling and this gives rise to a reduction in the ability to use the intake air flow for cooling purposes.

It is, therefore, a still further object of this invention to provide an improved outboard motor arrangement and cowling air inlet that is configured so that the air that is inducted into the protective cowling will effectively separate water but can be utilized to cool components of the engines such as the cam shaft drive.

SUMMARY OF THE INVENTION

This invention is adapted to be embodied in an outboard motor that is comprised of a power head consisting of a powering four-stroke internal combustion engine and a surrounding protective cowling. The engine is mounted in the power head so that its crankshaft rotates about a vertically disposed axis. A drive shaft housing and lower unit depends from the power head and contains a drive shaft that is coupled to the engine for driving thereby. This drive shall also rotates about a vertically-disposed axis and is coupled to a propulsion device for propelling an associated watercraft. The engine is provided with at least one overhead cam shaft for operating valves in a cylinder head of the engine that is affixed to an engine cylinder block at the end opposite the crankshaft. A flexible timing belt drives the cam shaft from the crankshaft in timed relationship. This flexible timing belt is disposed at the upper portion of the engine. The protective cowling is formed with an air inlet opening for admitting atmospheric air and which is juxtaposed to a portion of the timing belt. Means are provided for drawing air into the protective cowling through the air inlet and in a path that flows generally along the length of the flexible transmitter for cooling the flexible transmitter.

DETAILED DESCRIPTION OF THE PREFERRED EMBODIMENTS OF THE INVENTION

Figure 1:
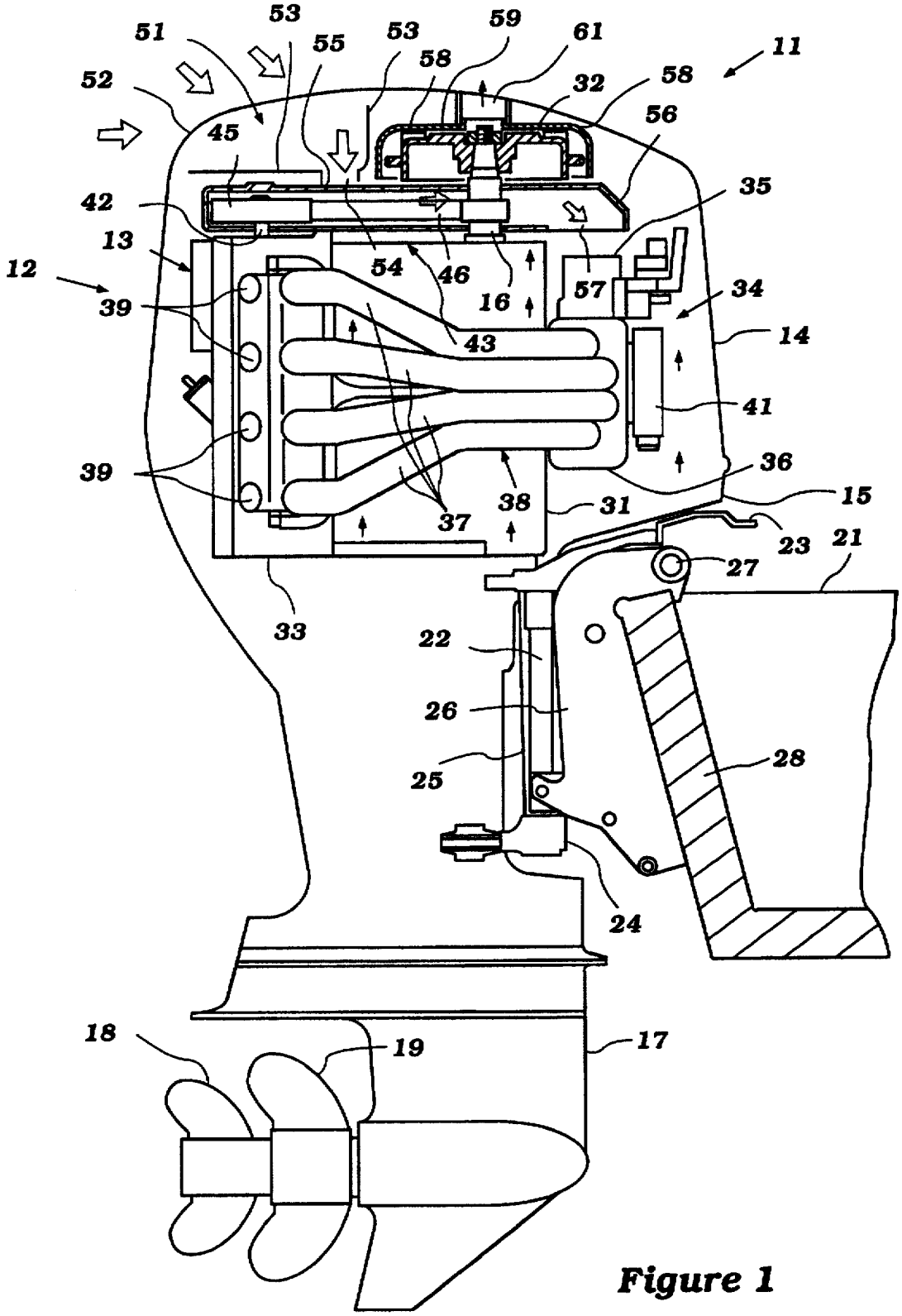
FIG. 1 is a side elevational view of an outboard motor constructed in accordance with an embodiment of the invention, with the protective cowling of the powerhead shown only in outline and with portions of the internal combustion engine broken away and shown in cross section to show a cooling arrangement for the engine.
Figure 2:
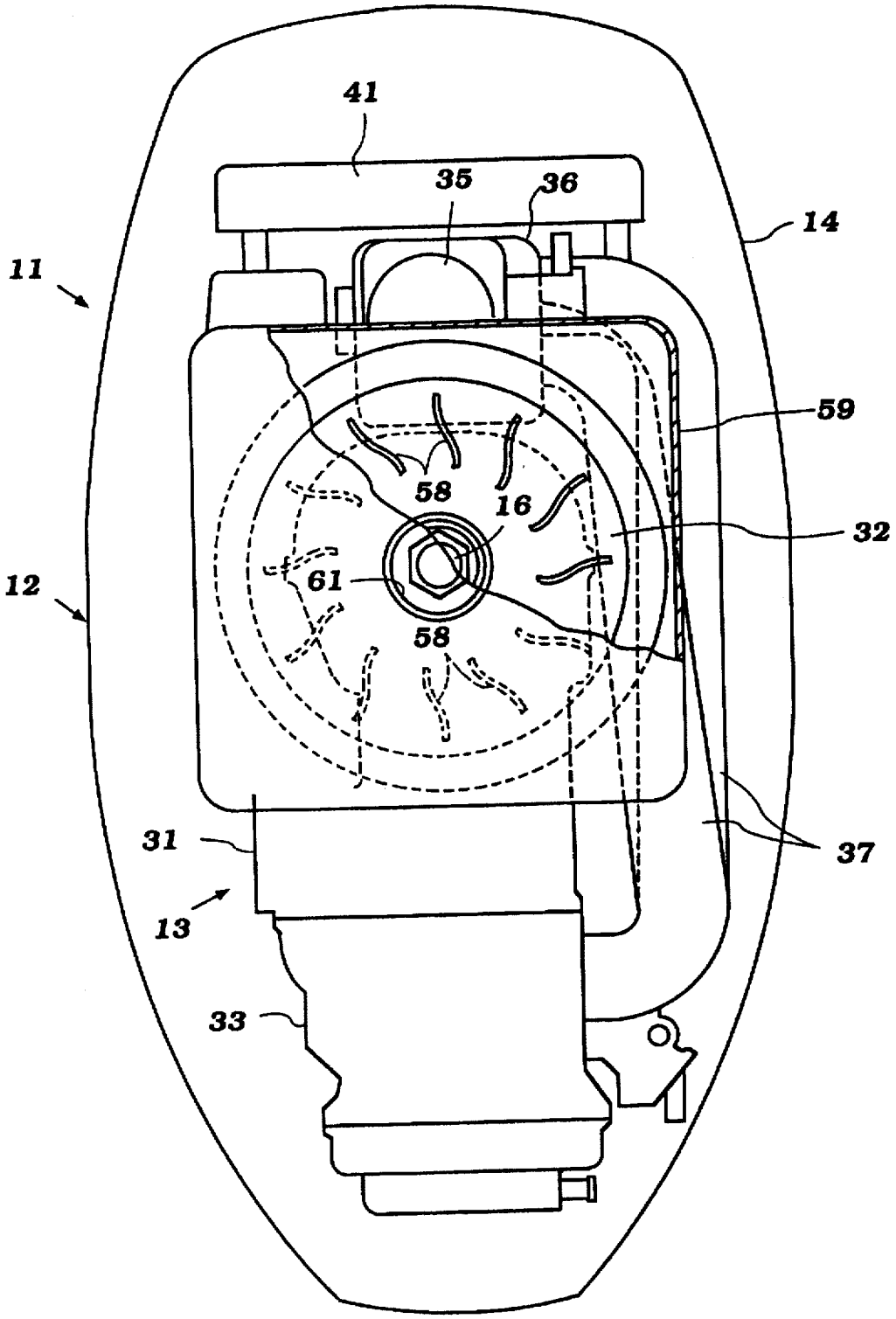
FIG. 2 is a top plan view of the outboard motor, with portions of the protective cowling removed and other portions broken away to show details of the cooling arrangement.

Referring now to the drawings, and initially to FIGS. 1 and 2, an outboard motor constructed in accordance with a first embodiment of the invention is indicated generally by the reference numeral 11. The outboard motor 11 is comprised of a power head 12 that includes a powering internal combustion engine 13. The engine 13 is surrounded by a protective cowling that is comprised of a main cowling portion 14 that is detachably connected to a tray portion 15. A guide plate (not shown) is surrounded by the tray 15 and upon which the engine 13 is mounted in any suitable manner.

As is typical with outboard motor practice, the engine 13 is supported within the power head 12 so that its output shaft, a crankshaft indicated by the reference numeral 16, rotates about a vertically disposed axis. This crankshaft 16 is rotatably coupled to a drive shaft (not shown) that depends into and is journaled within a drive shaft housing and lower unit 17. The tray 15 encircles the upper portion of the drive shaft housing and lower unit 17.

The lower end of the drive shaft is coupled to a conventional forward/reverse bevel gear transmission (not shown), which in turn is coupled to a propulsion device, namely contra-rotating propellers 18 and 19, for driving the propellers 18 and 19 in selected forward or reverse directions so as to so propel an associated watercraft 21.

A steering shaft 22 having a tiller 23 affixed to its upper end is affixed in a suitable manner by means which include a lower bracket assembly 24 to the drive shaft housing and lower unit 17. This steering shaft 22 is journaled within a swivel bracket 25 for steering of the outboard motor 11 about a vertically extending axis defined by the steering shaft 22.

The swivel bracket 25 is, in turn, connected to a clamping bracket 26 by means of a pivot pin 27. This pivotal connection permits tilt and trim motion of the outboard motor 11 relative to an associated transom 28 of the powered watercraft 21. The trim adjustment permits variation of the angle of attack of the propellers 18 and 19 to obtain optimum propulsion efficiency. In addition, the outboard motor 11 may be tilted up to and out of the water position for trailering and other purposes, as is well known in the art.

The engine 13 will now be described in detail with continued reference to FIGS. 1 and 2. The engine 13 is, in the illustrated embodiment, of the four-stroke, four-cylinder, in-line-type configuration. To this end, the engine 13 is provided with a cylinder block 31 in which four horizontally extending, parallel cylinder bores (not shown) are formed in a vertically spaced relationship with each other. Although the invention is described in conjunction with a four-cylinder in-line engine, it will be readily apparent to those skilled in the art how the invention may be utilized with engines having various cylinder numbers and cylinder configurations.

Pistons (not shown) reciprocate within the cylinder bores and are connected to connecting rods (not shown), which in turn are rotatably journaled on respective throws of the crankshaft 16, which is rotatably journaled within the forward portion of the cylinder block 31. A flywheel 32 is affixed to the upper end of the crankshaft 16. The flywheel 32 is used in association with the cooling arrangement for the engine 13 as will be discussed in detail later.

The ends of the cylinder bores opposite the forward end of the cylinder block 31 are closed by means of a cylinder head assembly that is indicated by the reference numeral 33 and which is affixed to the cylinder block 31 in any known manner. The cylinder head 33 has individual recesses (not shown) that cooperate with the cylinder bores and pistons to form engine combustion chambers. These combustion chambers are served by an induction system that is indicated by the reference numeral 34 and includes a throttle body 35. The throttle body 35 receives a supply of atmospheric air in a manner that will be discussed in detail later, and delivers this air to a plenum chamber 36. The amount of air delivered to the plenum chamber 36 is regulated by a throttle valve (not shown) that is disposed within the throttle body 35.

From the plenum chamber 36, the air is delivered through the runners 37 of an intake manifold 38 to intake passages (not shown) that are integrally formed in the cylinder head 33 where it is mixed with fuel injected into the intake passages by fuel injectors 39. The fuel injectors 39 receive a supply of fuel from a fuel tank (not shown) that is suitably positioned within the hull of the watercraft 21 and are controlled by an ECU 41 that is affixed to the forward side of the plenum chamber 36 by any suitable means. This air-fuel charge then enters the combustion chambers, past intake valves (not shown) that are slidably supported in the cylinder head 33 and which control the flow of induction charge into the combustion chambers.

In like manner, exhaust valves are slidably supported in the cylinder head 33 and control the flow of exhaust gases from the combustion chambers into exhaust passages (not shown) which are integrally formed in the cylinder head 33. These exhaust passages deliver the exhaust gases to an exhaust system (not shown) for silencing and discharging to the atmosphere through the body of water in which the watercraft 21 is operating, as is well known in the art.

The intake and exhaust valves are operated by a camshaft that is indicated by the reference numeral 42 and rotatably journaled within the cylinder head 32 along a vertically extending axis. The camshaft 42 is driven at one-half engine speed by the crankshaft 16 through a cam shaft drive assembly 43 that includes a crankshaft pulley 44 which is affixed to the upper end of the crankshaft 16 above the cylinder block 31 and beneath the flywheel 32. The crankshaft pulley 44 drives a camshaft pulley 45 that is affixed above the cylinder head 33 to the upper end of the camshaft 42 through a first flexible transmitter drive, namely, a toothed timing belt 46. Thus, the pulleys 44 and 45 and belt 46 are exposed above the engine 13.

The method by which atmospheric air is delivered to the induction system 34 will now be discussed in detail. It is the conventional practice with two-stroke outboard motors to deliver atmospheric air directly to the induction system through one or more air inlet openings formed in the protective cowling of the outboard motor. With the use of the above four-stroke engine as the powering means for the outboard motor, it is highly desirable to use the atmospheric air as a means for cooling the engine, and specifically the exposed cam shaft drive assembly 43. This embodiment of this invention accomplishes this by providing a fan-driven cooling arrangement that cooperates with the flow of inducted engine air to direct the atmospheric air across the cam drive assembly 43 before a portion of it enters the induction system.

With continued reference now to FIGS. 1 and 2, an air inlet cavity is indicated by the reference numeral 51 and includes one or more air inlet openings 52 formed in the upper rearward portion of the main cowling 14 contiguous to the camshaft pulley 45 and belt 46, and through which atmospheric air, indicated by the unshaded arrows of FIG. 1, enters the air inlet cavity 51. The air inlet cavity 51 includes a water separator of a known type (not shown) for separating water from the atmospheric air. The air inlet cavity 51 also includes wall portions 53 that serve as ducting for guiding the air through an outlet 54 that opens to a cam drive assembly housing inlet 55 of a cam drive assembly housing or baffle 56.

The cam drive assembly baffle 56 is affixed to the upper surface of the engine 13 by any suitable means and encloses the cam drive assembly 43. The forward end of the baffle 56 extends above the throttle body 35 and includes an outlet 57 contiguous to the crankshaft 16 through which the atmospheric air is directed toward the throttle body 35. Thus, the air inlet cavity 51 and cam drive assembly baffle 56 serve as means by which an air flow path across the cam drive assembly 43 is defined for the cooling of the assembly 43.

The flywheel 32 will now be discussed in detail. As previously stated, the flywheel 32 is used in association with the cooling arrangement. Specifically, the flywheel 32 is used as a pumping means by which atmospheric air in excess of that required for engine combustion is drawn into the protective cowling 14. For this purpose, a plurality of fan blades 58 are disposed circumferentially about the upper surface of the flywheel 32. The flywheel 32 additionally is covered by a ducting housing 59 whose upper end includes an outlet 61 that is affixed to and terminates at the top of the main cowling 14. This opening thus opens to the atmosphere.

The lower end of the housing 59 is open to the air in the power head 12, indicated by the shaded arrows in FIG. 1. Thus the fan formed by the flywheel will draw heated air from around the engine and exhaust it to the atmosphere. This will aid in further cooling the drive belt 46.

When the engine 13 is operating, the flywheel 32 is rotated by the crankshaft 16 and acts as a fan, with the blades 58 drawing air from within the power head 12 up through the lower end of the flywheel housing 59, and discharge the air to the atmosphere through the outlet 61. This generates a negative pressure within the power head 12 which, in turn, draws additional atmospheric air into the power head, 12 through the air inlet cavity 51 and across the cam drive assembly 43. Thus, the flywheel 32 draws atmospheric air into the power head 12 in addition to that drawn by the engine induction system to also ventilate the outboard motor 11.

Figure 3:
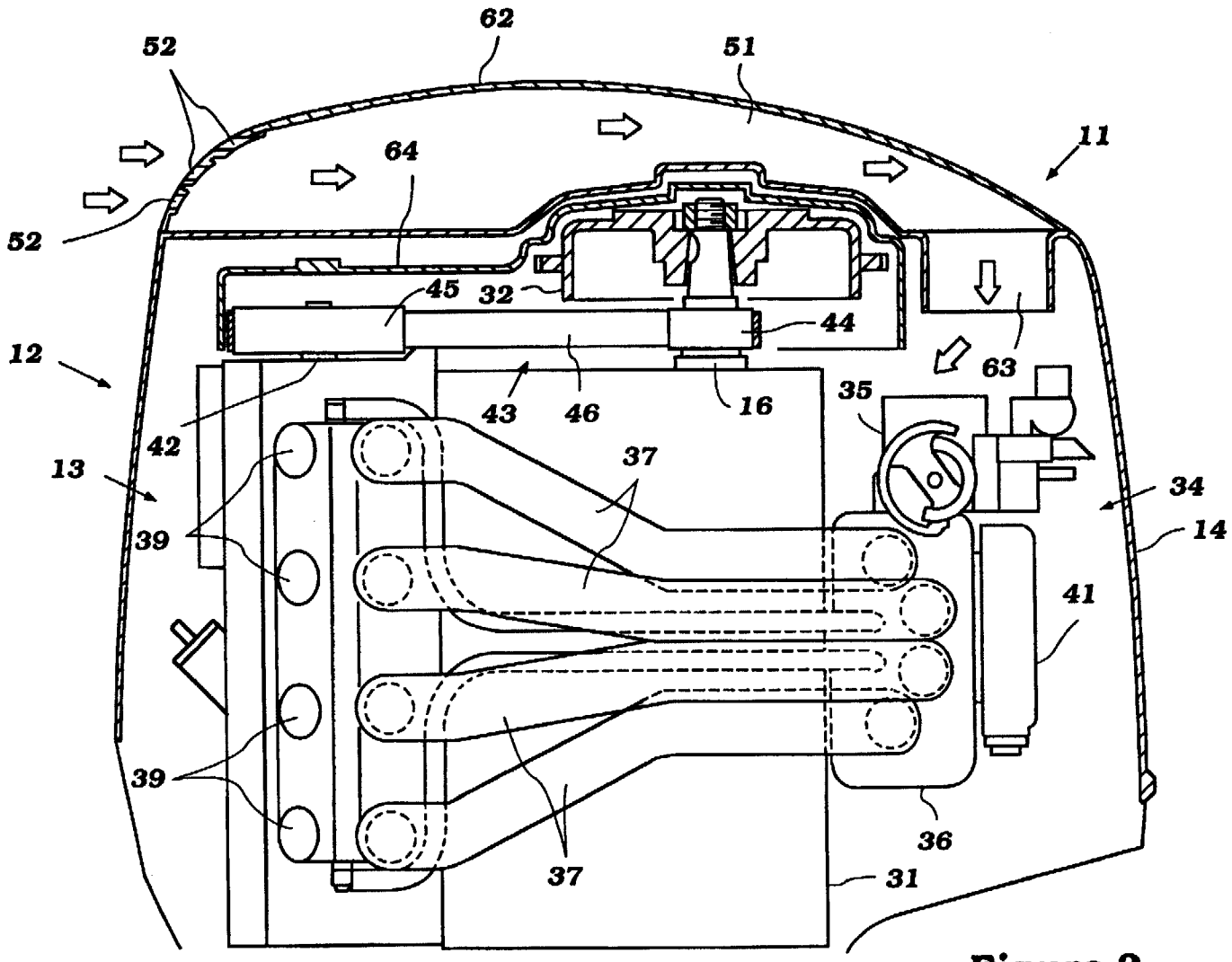
FIG. 3 is an enlarged side elevational view of the power head of another embodiment of the invention with the protective cowling and portions of the engine shown in section.

FIG. 3 illustrates another embodiment of the invention in which a different air flow arrangement is used to deliver the atmospheric air to the induction system 34 and across the drive belt 46 for its cooling without employing the flywheel 32 as a fan for assisting in the drawing of atmospheric air/into the power head 12. In this embodiment the air inlet cavity 51, which includes a water separator for separating water from the atmospheric air, is defined by a cover 62 that extends completely across the upper surface of the power head 12 and includes the air inlet openings 52 disposed along the rearward end of the cover 62. An outlet 63 is disposed at the forward end of the atmospheric air inlet cavity 51 in proximity to the induction system 34 inlet and directs the atmospheric air towards the throttle body 35.

A cover or baffle 64 is affixed to the engine 13 by any suitable means and encloses the cam drive assembly 43 and flywheel 32. The lower end of the baffle 64 is open to the power head 12.

With the above-described configuration, the atmospheric air is drawn into and across the air inlet cavity 51 in proximity to the cam drive assembly 43, and thus cools the cam drive assembly 43 before exiting the air inlet cavity 51 through the outlet 63 and entering the induction system 34. The entire air flow is created by the induction system demand. Thus the amount of cooling air flow will be related to engine speed and load. This is also in proportion to the heat generated in the drive belt 46. Thus the drive belt 46 will be adequately cooled under all conditions.

Aside from these differences this embodiment is the same as that previously described and thus like components are identified by like reference numerals and additional description of this embodiment is not believed to be necessary to permit those skilled in the art to practice this embodiment.

Figure 4:
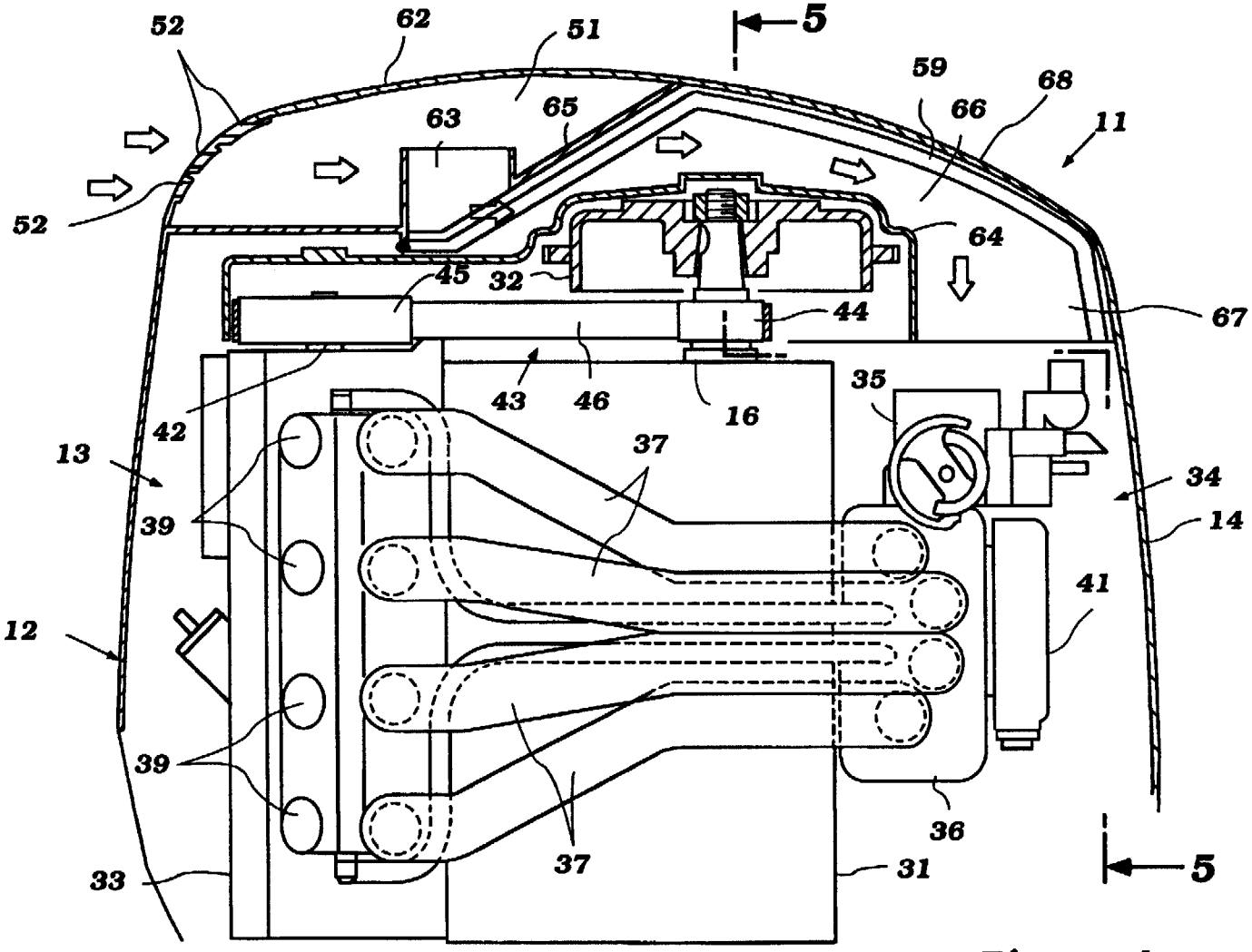
FIG. 4 is a side elevational view similar to FIG. 3 and illustrates another embodiment of the invention.
Figure 5:
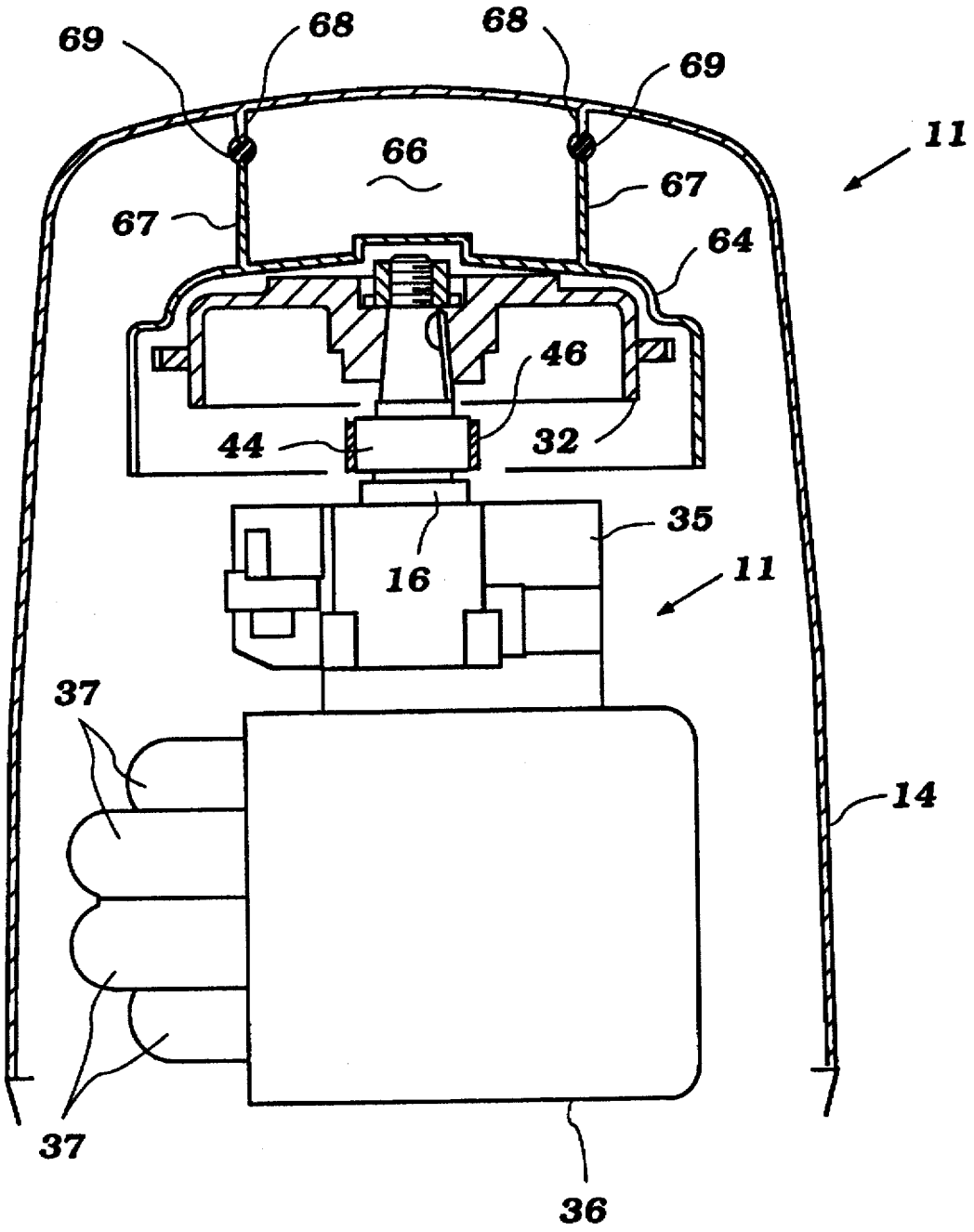
FIG. 5 is a cross-sectional view taken along line 5—5 of FIG. 4.

FIGS. 4 and 5 illustrate a further embodiment of the invention that is similar to the embodiment of FIG. 3. Where components of this embodiment are the same as or similar to those of the previously described embodiments the same reference numerals are applied to those components. They will be described further only where necessary to understand the construction and operation of this embodiment.

In this embodiment the air inlet cavity 51 is formed primarily at the rearward portion of the upper power head 12. The outlet 63 is formed in a forward inclined surface 65 of the cavity 51 and extends upwardly so as to cooperate with the water separator to impede any water from the body of water in which the watercraft 21 is operating from passing into the induction system 34 through the outlet 63.

The outlet 63 delivers the atmospheric air to an induction delivery chamber 66 that is defined by a pair of vertically extending walls 67 which are integrally formed with the cam drive baffle 64. These walls 67 extend upwardly from the upper surface of the baffle 64 and sealingly engage ribs 68 formed on the lower surface of the upper portion of the main cowling 14 through rubber grommets 69. This induction delivery chamber 66 begins at the camshaft end of the drive belt 46 and terminates at its lower end immediately above the throttle body 35 for delivering atmospheric air to the induction system 34. The above-described configuration for directing air into the induction system 34 also cools the cam drive assembly 43 by directing the atmospheric air forwardly across the drive belt 46 and in proximity to the cam drive assembly 43. This cooling is enhanced by the induction delivery chamber 66, since the induction delivery chamber 66 restricts the atmospheric air flow to a region in close proximity to the cam drive assembly 43 and specifically the belt 46.

Figure 6:
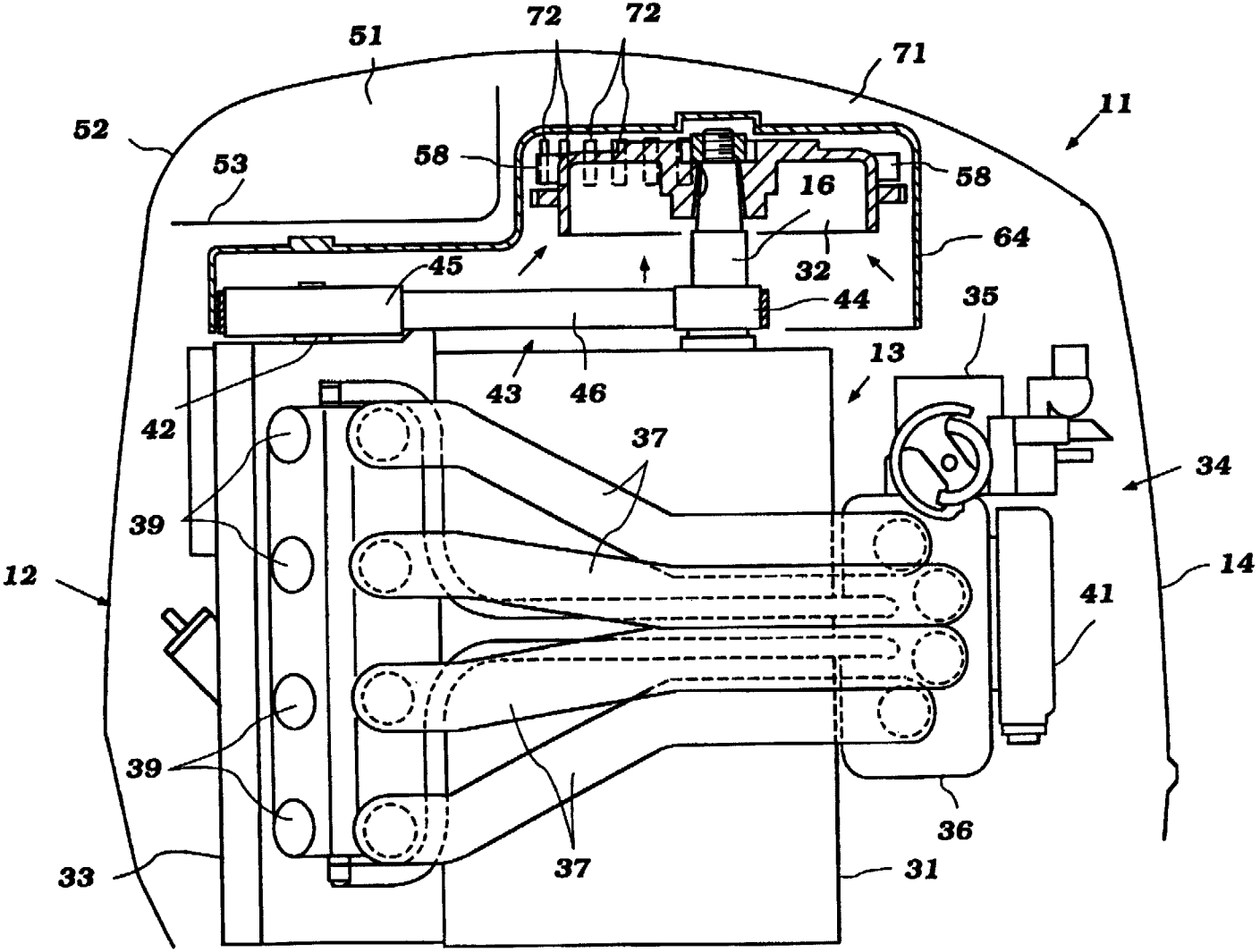
FIG. 6 is a side elevational view similar to FIGS. 3 and 4 and illustrates yet another embodiment of the invention.

FIG. 6 illustrates another embodiment of the invention in which the flywheel 32 is used as a fan for supplementing the drawing atmospheric air into the power head 12 in addition to that delivered by the action of the induction system 34.

The air is drawn into the air inlet cavity 51 where a known type of water separator (not shown) through the openings 52 and then into an induction delivery chamber 71, which comprises the upper forward portion of the main cowling member 14 and guides the air in proximity to the cam drive assembly 43 for cooling of the assembly 43 before delivering the air to the throttle body 35 of the induction system 34.

The cam drive assembly 43 and interior of the cowling 14 is further cooled by the air in the power head 12, indicated by the shaded arrows, which is drawn past the cam drive assembly 43 into the baffle 64 by the fan blades 58 of the flywheel 32 which are disposed circumferentially about the edge of the flywheel 32 before being discharged from the baffle 64 to the induction delivery chamber 66 through a plurality of vents 72.

Figure 7:
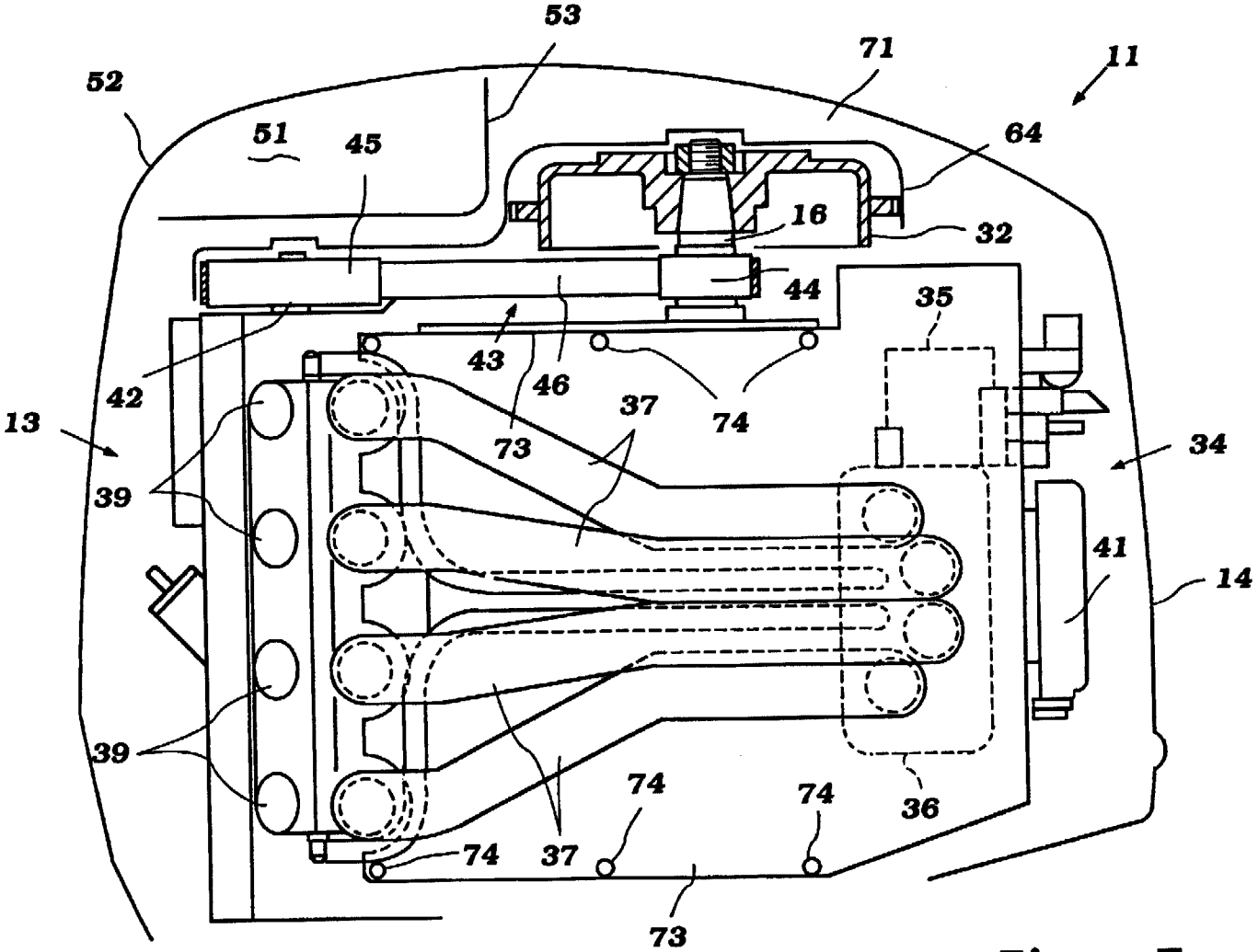
FIG. 7 is a side elevational view similar to FIGS. 3, 4 and 6 and illustrates another embodiment of the invention.
Figure 8:
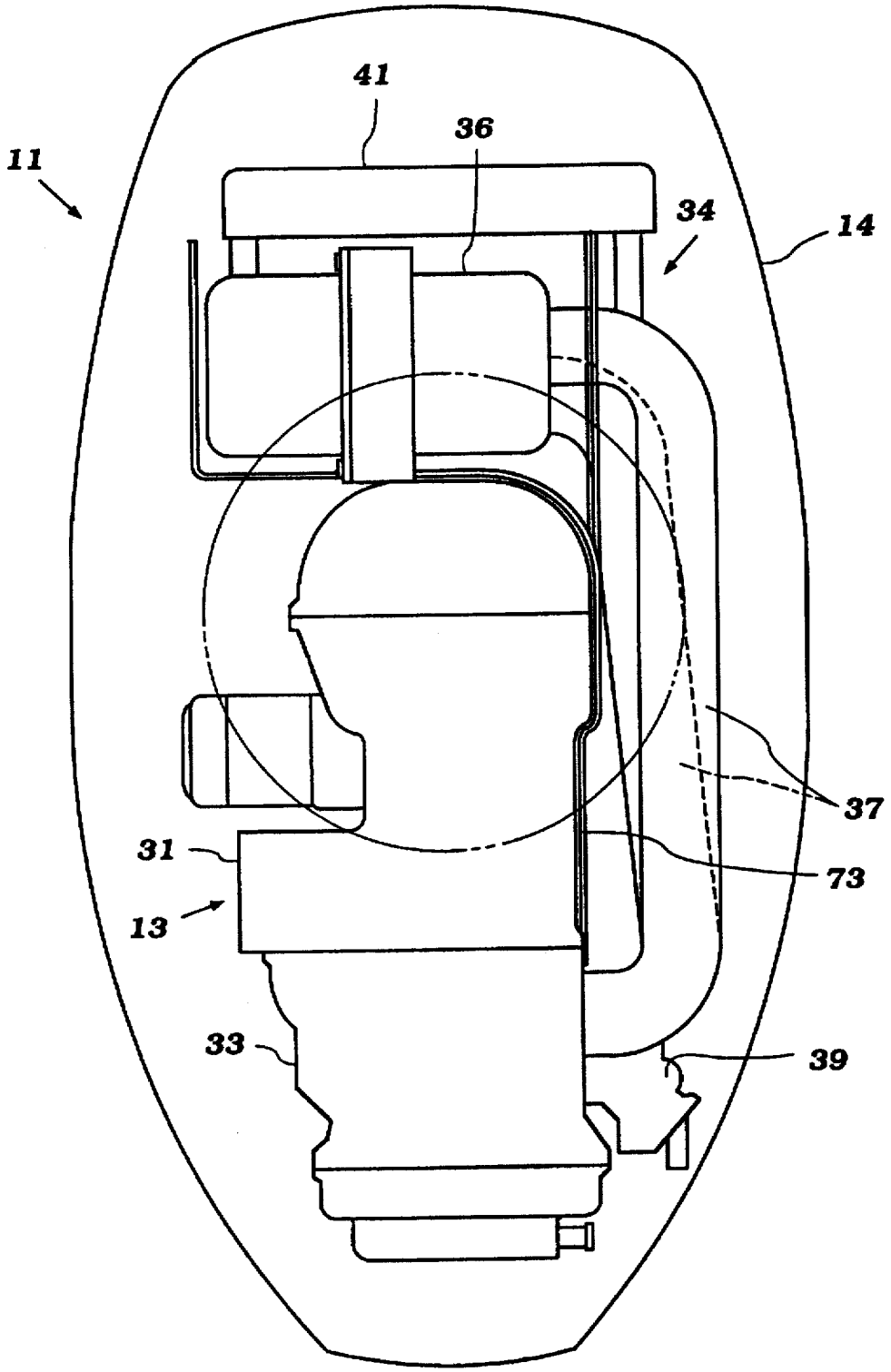
FIG. 8 is a top plan view of the embodiment of FIG. 7 with the upper portion of the protective cowling removed.

FIGS. 7 and 8 illustrate a further embodiment of the invention that can be used in conjunction with any of those embodiments already described or by itself. In this embodiment the flywheel 32 is not utilized as a fan, and the cam drive assembly 43 is cooled by the air flow through the air inlet cavity 51 and the induction delivery chamber 71 only. A baffle or heat shield is indicated by the reference numeral 73 and is affixed to the intake side of the engine 13 by bolts 74. As seen in FIG. 8, the heat shield 73 extends around to the exhaust side of the engine 13 where it acts to reduce the heat transfer from the exhaust system to the cam drive assembly 43. The heat shield additionally tends to reduce the heat transfer from the engine 13 to the induction system 34.

Thus, from the foregoing description it should be readily apparent that the described embodiments of the invention provide a very effective cooling arrangement for the timing belt of the overhead cam shaft of the engine. This cooling is accomplished without the necessity of introducing large amounts of water into the interior of the protective cowling. Of course, the foregoing description is that of preferred embodiments of the invention and various changes and modifications may be made without departing from the spirit and scope of the invention, as defined by the appended claims.

What is claimed is:

1. An outboard motor comprised of a power head consisting of a four-cycle internal combustion engine and a surrounding protective cowling, said engine being mounted in said power head so that a crankshaft of said engine rotates about a vertically-disposed axis, a drive shaft housing and lower unit depending from said power head, a drive shaft journaled for rotation within said drive shaft housing and lower unit and coupled to said crankshaft for driving thereby, a propulsion device driven by said drive shaft for propelling an associated watercraft, said engine comprising a cylinder block having at least one horizontally disposed cylinder bore, said crankshaft being rotatably journaled at one end of said cylinder block, the other end of said cylinder block being closed by a cylinder head affixed thereto, at least one cam shaft rotatably journaled in said cylinder head for operating valves therein, a flexible transmitter disposed at the top of said engine and driving said cam shaft in timing relationship from said crankshaft, a protective baffle extending across the upper surface of said flexible transmitter and having a depending portion surrounding al least the sides of said flexible transmitter for at least partially enclosing and protecting said flexible transmitter, said protective cowling having an air inlet opening formed in an upper portion thereof contiguous to said flexible transmitter for induction of air into said protective cowling for combustion within said engine, and means defining an air flow path from said atmospheric air inlet into the area enclosed by said protective baffle and directly across said flexible transmitter for cooling said flexible transmitter.

2. An outboard motor as set forth in claim 1, wherein the means for defining the air flow path across the flexible transmitter comprises means for drawing atmospheric air through the protective cowling atmospheric air inlet.

3. An outboard motor as set forth in claim 2, wherein the air is directed across the upper portion of the protective cowling and across the upper portion of the protective baffle and into the area enclosed by said protective baffle through an opening defined at least in part thereby.

4. An outboard motor as set forth in claim 3, further including baffle means formed at the upper portion of the protective cowling for directing the air flow into the opening defined by the protective baffle.

5. An outboard motor as set forth in claim 3, wherein the means for drawing air into the atmospheric air inlet opening comprises a fan contained within the protective cowling.

6. An outboard motor as set forth in claim 5, wherein the fan is driven from the engine.

7. An outboard motor as set forth in claim 6, further including a flywheel fixed for rotation with the engine crankshaft and wherein the fan is formed by the flywheel.

8. An outboard motor as set forth in claim 3, wherein the engine is provided with an induction system having an atmospheric air inlet opening and the inducting system atmospheric air inlet opening is configured for drawing the air across the flexible transmitter.

9. An outboard motor as set forth in claim 8, wherein the atmospheric air opening for the induction system is disposed contiguous to the crankshaft and the atmospheric air opening in the protective cowling is disposed contiguous to the cam shaft.

10. An outboard motor as set forth in claim 9, wherein the means for drawing air into the atmospheric air inlet opening further comprises a fan contained within the protective cowling.

11. An outboard motor as set forth in claim 10, wherein the fan is driven from the engine.

12. An outboard motor as set forth in claim 6, further including a flywheel fixed for rotation with the engine crankshaft and wherein the fan is formed by the flywheel.

13. An outboard motor as set forth in claim 1, further including an exhaust system for the engine for discharging exhaust gases therefrom and a baffle interposed between the exhaust system and the flexible transmitter for reducing the heat transfer from the exhaust system to the flexible transmitter.

* * * * *

UNITED STATES PATENT AND TRADEMARK OFFICE

CERTIFICATE OF CORRECTION

PATENT NO. : 5,713,772
DATED : February 3, 1998
INVENTOR(S) : Takahashi et al.

It is certified that error appears in the above-identified patent and that said Letters Patent is hereby corrected as shown below:

Column 9,
Line 19, please change "the inducting" to -- the induction --.

Signed and Sealed this

Twenty-seventh Day of August, 2002

*Attest:*

*Attesting Officer*

JAMES E. ROGAN
*Director of the United States Patent and Trademark Office*